United States Patent [19]

Valdo

[11] 4,003,738

[45] * Jan. 18, 1977

[54] METHOD OF PURIFYING ALUMINUM

[75] Inventor: Alex R. Valdo, Phoenix, Ariz.

[73] Assignee: Ethyl Corporation, Richmond, Va.

[ * ] Notice: The portion of the term of this patent subsequent to Nov. 5, 1991, has been disclaimed.

[22] Filed: Dec. 10, 1975

[21] Appl. No.: 639,263

Related U.S. Application Data

[63] Continuation-in-part of Ser. No. 240,864, April 3, 1972, which is a continuation of Ser. No. 26,752, April 8, 1970, abandoned, and a continuation-in-part of Ser. No. 168,363, Aug. 2, 1971, Pat. No. 3,846,122, which is a continuation-in-part of Ser. No. 26,751, April 8, 1970, abandoned.

[52] U.S. Cl. ..... 75/68 C; 75/68 R; 75/93 AC

[51] Int. Cl.[2] ..... C22B 21/00

[58] Field of Search ..... 75/68 R, 68 C, 63, 93 R, 75/93 AC

[56] References Cited

UNITED STATES PATENTS

| | | | |
|---|---|---|---|
| 1,743,515 | 1/1930 | Anderson | 75/68 R |
| 3,144,323 | 8/1964 | Watson et al. | 75/68 R |
| 3,170,787 | 2/1965 | Tanaka et al. | 75/68 C |
| 3,650,730 | 3/1972 | Derham | 75/68 R |
| 3,846,122 | 11/1974 | Valdo | 75/68 C |

FOREIGN PATENTS OR APPLICATIONS

| | | | |
|---|---|---|---|
| 624,104 | 7/1961 | Canada | 75/68 R |
| 634,801 | 1/1962 | Canada | 75/68 R |

*Primary Examiner*—M. J. Andrews
*Attorney, Agent, or Firm*—Donald L. Johnson; John F. Sieberth; Paul H. Leonard

[57] ABSTRACT

A metallurgical process wherein aluminum carbide or other carbides are removed from partially pure aluminum formed by decomposition of an alkyl aluminum compound by treating the aluminum in molten form under a molten cover flux with a stream of chlorine.

11 Claims, No Drawings

METHOD OF PURIFYING ALUMINUM

CROSS-REFERENCE TO RELATED APPLICATIONS

This application is a continuation-in-part of application Ser. No. 240,864, filed Apr. 3, 1972, now pending, which application is a continuation of application Ser. No. 26,752, filed Apr. 8, 1970, now abandoned, and a continuation-in-part of application Ser. No. 168,363, filed Aug. 2, 1971, now U.S. Pat. No. 3,846,122. The latter application is in turn a continuation-in-part of application Ser. No. 26,751, filed Apr. 8, 1970, now abandoned.

BACKGROUND OF THE INVENTION

1. Field of the Invention

The present invention is in the field of metallurgy and relates in particular to the manufacture of non-ferrous metals such as aluminum.

2. Description of the Prior Art

Processes for the production of aluminum by thermal decomposition of pyrolysis of alkyl aluminum compounds have been suggested by K. Ziegler et al., U.S. Pat. No. 2,843,474 and by Ikeda et al., U.S. Pat. No. 3,154,407. In these processes, however, the actual production of aluminum is generally accompanied by the formation of a considerable amount of aluminum carbide as a by-product.

Formation of this undesirable aluminum carbide is discussed in an article by K. Ziegler et al., Annalen der Chemie, Vol. 629, Nos. 1–3, March 1960, p. 210–221, Metalloorganic Compounds XXXVIII "Pyrolysis of Al trialkyls" by Karl Ziegler, Konrad Nogel and Werner Pfohl.

The formation of the by-product, aluninum carbide, decreases the yield of aluminum produced by the thermal decomposition. It is also widely known in the manufacturing industry that the inclusion of a considerable amount of aluminum carbide in aluminum deleteriously effects the processability, corrosion resistance and other characterstics of the product aluminum.

One attack on the carbide problem is proposed by Tanaka et al., U.S. Pat. No. 3,170,787, wherein by regulating the rate of decomposition of the alkyl aluminum compound, the amount of carbide formed is controlled. Such a process requires a high degree of skill and is difficult to carry out effectively.

The present invention is directed to a process wherein these aluminum carbides can be readily removed with comparative ease.

SUMMARY OF THE INVENTION

In the present invention, aluminum carbide, usually $Al_4C_3$, is removed from partially pure aluminum prepared by decomposition or pyrolysis of an alkyl aluminum compound, by treating the resulting carbide containing aluminum in molten form under a molten cover flux with a stream of chlorine or chlorine-generating material. Such treatment readily removes carbides from the aluminum.

Cryolite gives particularly good results when used as the cover flux, but any fluoride type, aluminum flux may be used. Thus a cover flux of sodium chloride, potassium chloride and cryolite is also suitable, as is a flux of 40% sodium chloride, 40% potassium chloride and 20% cryolite, all percentages by weight. The latter flux has been found particularly effective.

Aluminum prepared from the decomposition of tripropylaluminum is especially preferred to aluminum prepared from other aluminum alkyl compounds since a purer final product is obtained.

The present invention provides an inexpensive method for purifying aluminum prepared by decomposition of alkyl aluminum compounds when compared with zone refining methods and other complicated prior art procedures.

DESCRIPTION OF THE PREFERRED EMBODIMENT

In the preferred embodiment of the invention, chlorine gas is bubbled into a molten bath of the relatively pure aluminum carbide-containing aluminum under a cover flux. This action effectively removes the carbides from the aluminum.

In addition to chlorine gas, compounds which liberate chlorine may be used in lieu thereof. Chlorinated hydrocarbons are suitable compounds, with hexachloroethane being a preferred compound. Aluminum chloride is another example of a preferred type of chlorine liberating compound.

Additionally, mixtures of chlorine gas and inert gases can be used. A preferred mixture of such gases is chlorine plus nitrogen.

A number of studies have been made to illustrate the effectiveness and/or efficiency of the present metallurgical process.

GENERAL PROCEDURE

Aluminum powder prepared by the decomposition of tri-n-propyl aluminum was examined to establish a base line. The aluminum produced by such decomposition had a relatively high aluminum carbide ($Al_4C_3$) content, running from about 0.34 to about 1.77 percent by weight. The aluminum powders were divided into several samples, and each sample was then compacted using 50 tons of ram pressure. The samples were then placed in a graphite crucible and heated in an electric furnace. The aluminum was melted under a molten cover flux and treated or fluxed with chlorine gas for a predetermined amount of time.

A steady stream of chlorine gas was bubbled through the aluminum sample after it was completely melted by means of a dip tube that was dipped into the molten sample. Upon the completion of the bubbling, the dip tube was removed and the melts were stirred and skimmed. The samples were cast into discs and permitted to cool and solidify. Drillings from the discs were then analyzed for carbide content by Gas Evolution-VPC Method.

A control sample of high purity aluminum was similarly treated. Other samples of aluminum produced by decomposition of an aluminum alkyl compound were treated only with chlorine or only with a cryolite cover flux. With the small samples used in the comparative tests, the cover flux of cryolite also promoted melting. Chunks of aluminum powder (0.150 inches thick × 0.500 square inches area) would not flow together without a cover flux. The results of these tests are set forth hereinafter in Table I.

EXAMPLE I

A sample of aluminum powder obtained from the thermal decomposition of tri-n-propyl aluminum, which powder contained 1.15 percent aluminum carbide and weighed 73.7 grams, was compacted at 50 tons ram pressure. The compacted sample was melted at a temperature of 1900° F. The melt was skimmed and fluxed with a stream of bubbling chlorine for approximately three minutes. To minimize carbon contamination, the powder compact was melted in a magnesium oxide thimble. Since no cover flux was used, aluminum recovery was low, estimated to be less than 50 percent. Upon VPC analysis after casting of the treated sample, no $CH_4$ was present. All aluminum carbide was removed.

EXAMPLE II

Large size chunks of aluminum of a size approximately 0.150 inches thick and 0.500 square inches in area obtained from the same source as Example I and weighing a total of 15 grams were melted at a temperature of 1850° F. Straight charging of the large chunks into the heated graphite crucible did not cause the chunks to flow together. The aluminum was very clean of hydrocarbons as very little flaming and no smoking occurred. A cryolite flux weighing 15 grams was added to the sample and this produced a consolidated pool of the molten aluminum. Soaking was continued for 10 minutes and thereafter the sample was allowed to solidify. This fluxing treatment resulted in an 80% melt efficiency. VPC analysis showed an aluminum carbide content of 0.026% in the recovered aluminum.

EXAMPLE III

A sample of large pieces of aluminum containing 0.33% aluminum carbide from the same source as Example I, weighing 35 grams was melted under a molten cryolite flux weighing 35 grams. Chlorine was introduced for one minute at a metal temperature of 1800° F. Melt efficiency was 80%. VPC analysis of drillings from the recovered metal showed no $CH_4$ was evolved. No aluminum carbide was thus apparent in the treated sample.

EXAMPLE IV

A sample of aluminum powder from the same source as Example III and weighing 54.7 grams was melted. The melt temperature was 1800° F. The melt was held at this temperature for 30 minutes and then treated with chlorine gas for 1.5 minutes. The sample was then skimmed and cast. Melt efficiency was approximately 72 percent. VPC analysis showed on aluminum carbide content of 1.03 percent in the recovered metal. A retest was run with a resulting aluminum carbide content of 3.4 percent. A second retest was run with a resulting aluminum carbide content of 0.96 percent.

EXAMPLE V

Approximately 32 grams of the sample obtained from the first retest in Example IV and containing 3.4 percent aluminum carbide was melted at a temperature of 1550° F. The sample was soaked for 30 minutes, stirred, and skimmed. Approximately 4 grams of skimmings were removed. The molten aluminum remaining was fluxed with a stream of chlorine gas for one minute and then poured into a small cast iron mold, allowed to solidify and then drilled. VPC analysis of the drillings showed 0.97 percent aluminum carbide.

EXAMPLE VI

Approximately 28 grams of the sample from Example V containing 0.97 percent aluminum carbide, was remelted. After the sample had melted, 10 grams of cryolite were added. The melt was then soaked for 30 minutes at a temperature of 1700° F and then stirred with a stainless steel spatula. Part of the spatula melted. The treated aluminum was poured into a cast iron mold, allowed to cool and solidify, and then drilled. VPC analysis of the drillings showed an aluminum carbide content of 0.63 percent.

EXAMPLE VII

A sample of aluminum powder obtained from the decomposition of triisopropyl aluminum and containing 0.51 percent aluminum carbide and weighing 45 grams, was melted at a temperature of 1800° F. The sample was soaked at that temperature for 30 minutes under a cover flux of 20 grams of cryolite. The treated aluminum was then separated, cast, allowed to cool, solidified and drilled. VPC analysis of the drillings showed an aluminum carbide content of 0.09 percent.

EXAMPLE VIII

The sample obtained in Example VII, weighing 36 grams and containing 0.09 percent aluminum carbide, was remelted at a temperature of 1600° F, fluxed with a stream of chlorine gas for one minute, skimmed of what appeared to be carbon, cast, allowed to cool, solidified and drilled. VPC analysis of the drillings showed no apparent aluminum carbide.

EXAMPLE IX

A control sample of primary aluminum metal, containing no aluminum carbide and weighing 100 grams was melted and treated using the procedure of Example VIII. VPC analysis of the drillings showed no aluminum carbide present.

Table I

| | Fluxing Treatment | | Wt % $Al_4C_3$ | |
|---|---|---|---|---|
| Sample | Cryolite | $Cl_2$ | Before Treatment | After Treatment |
| Ex. I* | No | Yes | 1.15 | None |
| Ex. II | Yes | No | 0.33 | 0.026 |
| Ex. III | Yes | Yes | 0.33 | None |
| Ex. IV | No | Yes | 1.15 | 1.03 |
| Ex. IV (Retest) | No | Yes | 1.15 | 3.4 |
| Ex. IV (Second Retest) | No | Yes | 1.15 | 0.96 |
| Ex. V | No | Yes | 3.4 | 0.97 |
| Ex. VI | Yes | No | 0.97 | 0.63 |
| Ex. VII | Yes | No | 0.51 | 0.09 |
| Ex. VIII | No | Yes | 0.09 | None |

Table I-continued

| Sample | Fluxing Treatment | | Wt % $Al_4C_3$ | |
|---|---|---|---|---|
| | Cryolite | $Cl_2$ | Before Treatment | After Treatment |
| Ex. IX** | No | Yes | None | None |

*Melted in a MgO thimble in a graphite crucible.
**Control sample-high purity aluminum.

From the foregoing examples and table, it is readily seen that treatment with both chlorine and a cryolite cover flux effectively reduces the carbide content of aluminum produced from the decomposition of alkyl aluminum compounds. Although some reduction in carbide content is usually obtained in using cryolite alone or chlorine alone, the results are inconsistent. Since Example VIII utilized the product of Example VII for treatment, the resulting effect can be said to be a combination treatment with cryolite and chlorine. Thus in each case where both fluxing and/or treating agents was used, the end product contained no aluminum carbide.

Similar results are obtained when hexachloroethane or $AlCl_3$ are bubbled through in place of or in admixture with the chlorine. Hexachloroethane is a by-product of chlorination operations and is available at very low cost. The use of such a material to generate the chlorine for the carbide removal makes the process of the present invention particularly attractive for commercial operation.

The foregoing disclosure and description of the invention is illustrative and explanatory thereof and various changes may be made within the scope of the appended claims without departing from the spirit of the invention.

What is claimed is:

1. A process for purifying aluminum carbide containing aluminum formed by decomposition of an alkyl aluminum compound, comprising the steps of:

a. melting the aluminum under a molten fluoride cover flux;

b. bubbling through the body of molten aluminum a stream of gas containing chlorine but otherwise essentially inert, until the carbide content of the aluminum is essentially removed; and, c. separating the treated aluminum from the flux and any dross formed thereon and casting the separated aluminum to thereby form an aluminum product substantially free of aluminum carbide.

2. The process of claim 1, wherein the cover flux is substantially cryolite.

3. The process of claim 1, wherein the cover flux is a mixture of sodium chloride, potassium chloride and cryolite.

4. The process of claim 1, wherein the cover flux is a mixture by weight of 40% sodium chloride, 40% potassium chloride and 20% cryolite.

5. The process of claim 1, wherein the chlorine is obtained from a compound liberating chlorine upon heating to the treating temperature.

6. The process of claim 5, wherein the chlorine liberating compound is a chlorinated hydrocarbon.

7. The process of claim 6, wherein the chlorinated hydrocarbon is hexachloroethane.

8. The process of claim 5, wherein the chlorine liberating compound is aluminum chloride.

9. The process of claim 1, wherein the stream of chlorine is combined with an inert gas.

10. The process of claim 9, wherein the inert gas is nitrogen.

11. The process of claim 1, wherein the aluminum to be purified is formed by the decomposition of tripropylaluminum.

* * * * *